US007757332B1

(12) United States Patent
Hale

(10) Patent No.: US 7,757,332 B1
(45) Date of Patent: Jul. 20, 2010

(54) SEWER CLEANING MACHINE

(75) Inventor: C. David Hale, Wilmington, OH (US)

(73) Assignee: Electric Eel Manufacturing Co., Inc., Springfield, OH (US)

( * ) Notice: Subject to any disclaimer, the term of this patent is extended or adjusted under 35 U.S.C. 154(b) by 129 days.

(21) Appl. No.: 11/471,423

(22) Filed: Jun. 20, 2006

(51) Int. Cl.
*B08B 9/04* (2006.01)

(52) U.S. Cl. ..... 15/104.33; 248/615; 280/47.24; 301/64.101; 301/64.701

(58) Field of Classification Search ..... 15/104.33; 280/47.17, 47.24, 48.27, 47.28, 47.27; 248/129, 248/615, 616; 301/64.701, 64.702, 64.703, 301/64.101, 64.102
See application file for complete search history.

(56) References Cited

U.S. PATENT DOCUMENTS 1,826,820 A * 10/1931 Perkins et al. ..... 68/3 R
2,564,248 A * 8/1951 Chenette ..... 280/47.27
2,868,558 A * 1/1959 Krauss ..... 280/47.131
2,890,890 A * 6/1959 Uhlrig et al. ..... 280/47.12
2,926,372 A * 3/1960 O'Brien ..... 15/104.33
3,026,224 A * 3/1962 Rogers, Jr. ..... 428/167
3,075,217 A * 1/1963 Kollmann ..... 15/104.33
3,952,786 A * 4/1976 Kreling et al. ..... 152/323
4,364,139 A 12/1982 Babb et al.
5,031,276 A 7/1991 Babb et al.
5,211,213 A * 5/1993 Hicks ..... 152/323
5,309,595 A 5/1994 Salecker et al.
5,316,377 A * 5/1994 Markling et al. ..... 301/64.701
5,622,319 A * 4/1997 Babb et al. ..... 239/722
6,468,048 B1 * 10/2002 Burkholder et al. ..... 417/234
6,618,891 B2 9/2003 Schmitt
2004/0012247 A1 * 1/2004 Lin et al. ..... 301/95.101

* cited by examiner

*Primary Examiner*—Mark Spisich
(74) *Attorney, Agent, or Firm*—Frost Brown Todd LLC

(57) ABSTRACT

Disclosed herein is an improved rotary drain cleaning machine having an improved support structure that prevents walking of the machine when in use. The machine is supported upon two rear mounted wheels and a forward pedestal.

3 Claims, 3 Drawing Sheets

SEWER CLEANING MACHINE

BACKGROUND OF THE INVENTION

The present invention generally relates to sewer cleaning machines having a belt driven drum, or basket, which typically stores therein, and drives, a pipe cleaning cable or "snake." More particularly the present invention teaches a unique and novel support structure for eliminating the classic wobble, or walking tendency, of prior art machines when operating.

PRIOR ART

Typically prior art sewer cleaning machines comprising a belt driven drum, or basket, which typically stores therein and drives a pipe cleaning cable or "snake," employ a mobile support system having a pair of spaced apart rear wheels and a forwardly positioned support generally comprising a lateral, floor engaging bar or a pedestal foot. The prior art wheels typically comprise a center disc having a pneumatic, or semi-pneumatic, elastomeric tire mounted thereon. For example see U.S. Pat. No. 5,309,595 issued to Salecker et al.

During operation, the combined weight of the drum, with approximately 100 to 200 lineal feet of cable wrapped therein is approximately 135 pounds. As the cable is wrapped within the drum it will wrap in an unsymmetrical manner thereby creating an "off-center," or eccentric center of mass within the rotatable drum or basket. Thus as the drum, or basket, is rotated, during operation of the machine, the eccentricity of the loaded cable within the drum, or basket, causes the machine to "wobble" side to side, whereby the machine will "walk" across its supporting surface.

One attempt to cure the machine walking problem is proposed by Babb et al. in U.S. Pat. No. 5,031,276 wherein Babb et al. suggests use of a retractable wheel stabilizing means that is lowered into place making contact with the machine's supporting surface thereby slightly lifting the wheel above the supporting surface.

BRIEF SUMMARY OF THE INVENTION

Although the mechanics of the "walking" problem is not fully understood it is believed that as the eccentric center of cable mass rotates asymmetrically about the drum axis of rotation a centrifugal force, acting away from the axis of the drum rotation is created.

Facing the front of the drain cleaning machine and using the points of the twelve hour clock as a reference, as the eccentric centrifugal force is directed downward at the six o'clock position the centrifugal force is shared by both wheels and the forward surface engaging support. However, as the centrifugal force rotates toward the nine o'clock position the centrifugal force imparts a moment about the approaching wheel upon the machine. The imparted moment now tends to compress the approached pneumatic, or semi-pneumatic, tire and further causes the expansion of the opposite pneumatic, or semi-pneumatic, tire thereby causing the machine to rock, or wobble, sideways and thereby reduces the frictional engagement between the opposite tire and supporting surface. Thus the pneumatic or non-pneumatic tires are assisting the rocking, or wobbly, motion of the machine rather than resisting the motion.

As the eccentric centrifugal force passes the nine o'clock position and approaches the twelve o'clock position, the centrifugal force tends to lift the wheel just passed and compress the opposing wheel. At the twelve o'clock position the eccentric centrifugal force tends to lift both wheels from the supporting surface. It is believed that by this action upon the compressible support wheels that a rocking, "wobbling" motion is the cause of the machine "walking" across the supporting surface.

It has been discovered that by replacing the prior art pneumatic and/or semi-pneumatic tires with a relatively incompressible, solid elastomeric tire, the cyclic expansion and compression of the pneumatic, or semi-pneumatic, tires is eliminated and the solid tires now resist the side to side rocking, or "wobble," of the machine rather than assisting it thereby preventing the walking phenomena experienced in the prior art machines

DETAILED DESCRIPTION OF THE INVENTION

Figure 1:
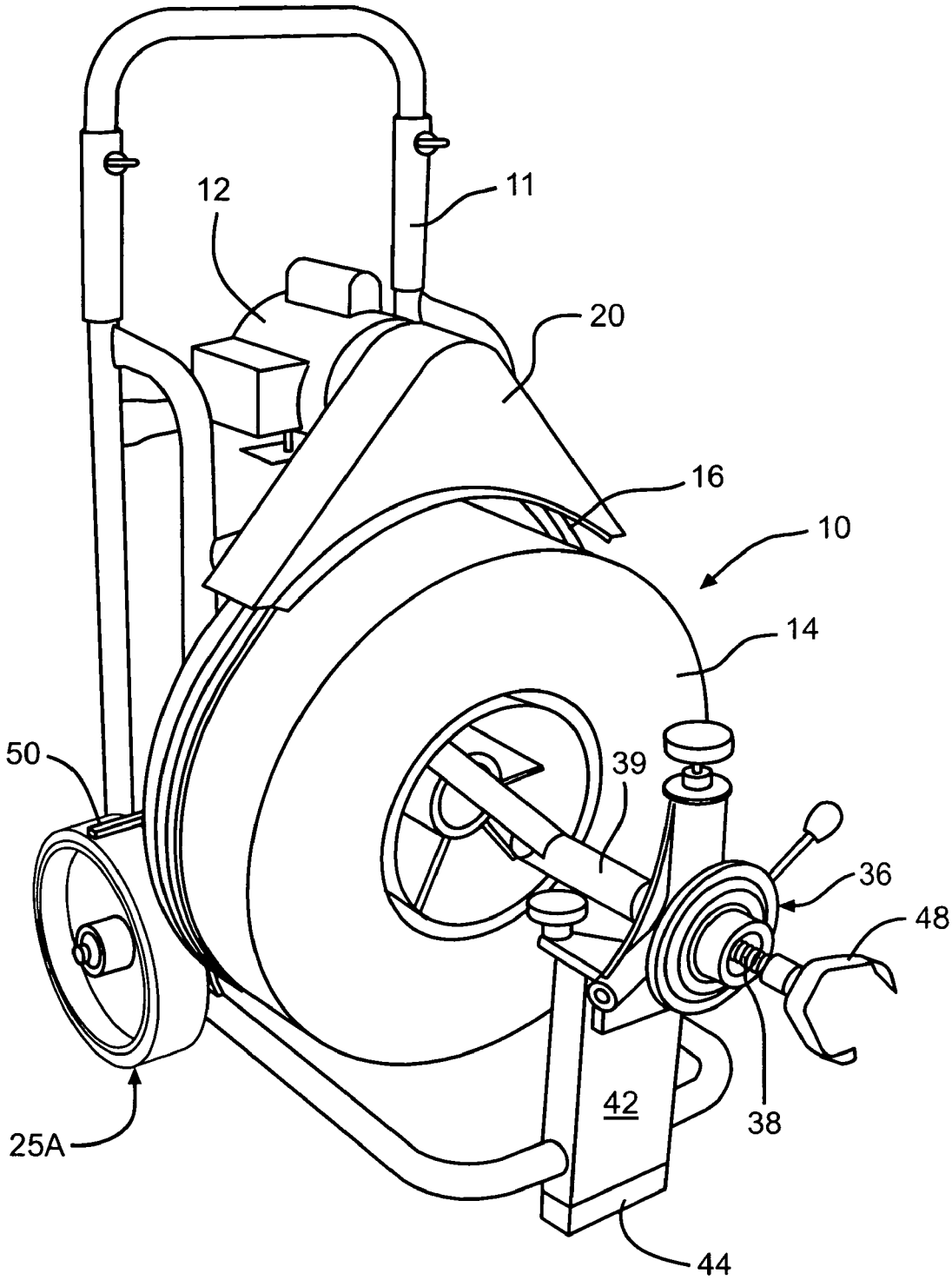
FIG. 1 presents a perspective view of a belt driven, rotating drum, drain cleaning machine embodying the present invention.
Figure 2:
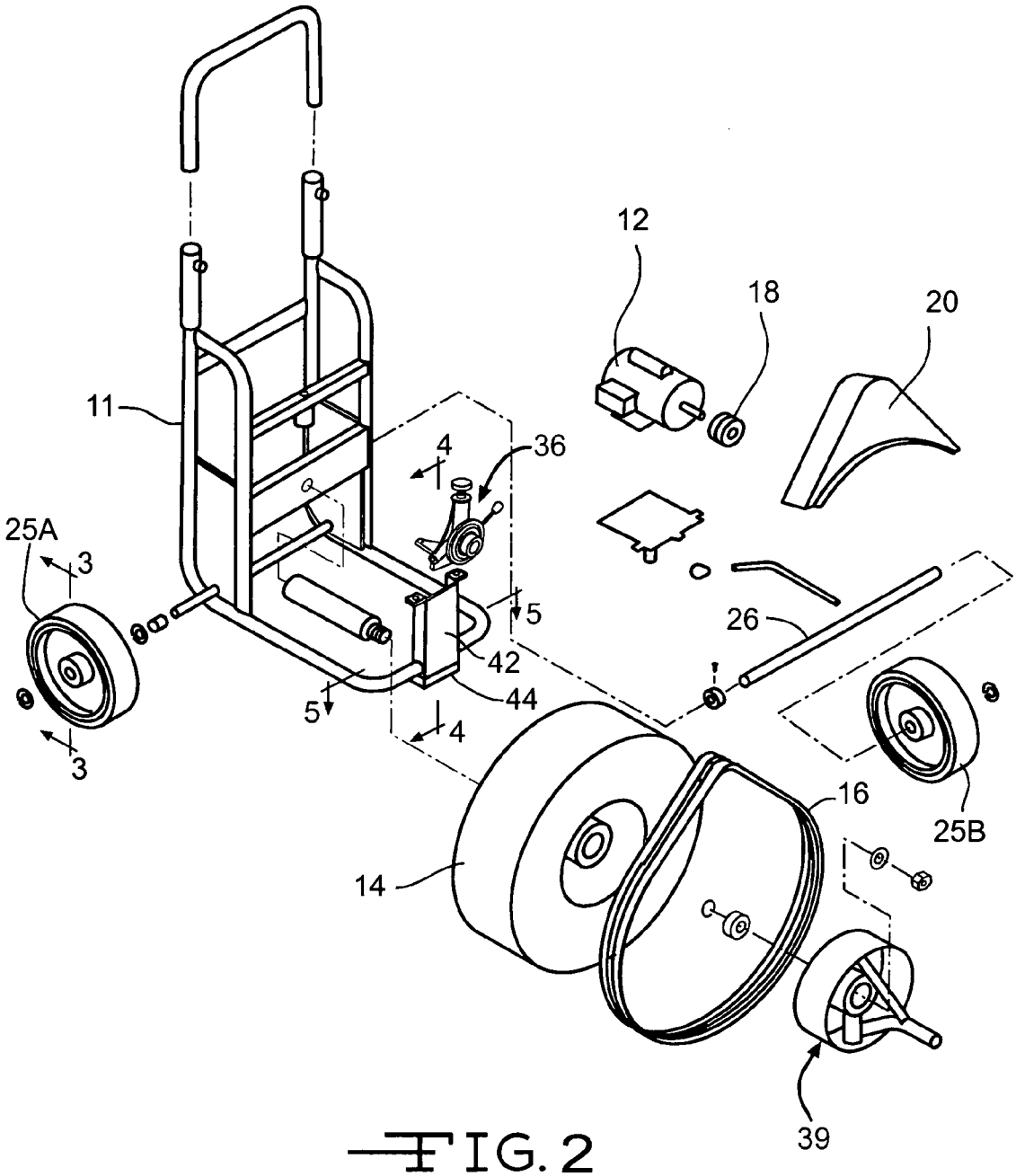
FIG. 2 presents an exploded perspective of the belt driven rotating drum drain cleaning machine shown in FIG. 1.

FIGS. 1 and 2 present a typical belt driven drum-type drain cleaning machine 10. Drain cleaning machine 10 comprises a base frame 11. Supporting thereon an electric driving motor 12, a cable storage drum 14 driven by way of an endless drive belt 16 typically wrapping about the circumference of drum 14 and drive pulley 18 attached to the motor output shaft. A safety shield, or cover, typically encloses the motor output shaft and drive pulley 18 as illustrated.

As illustrated, base frame 11 includes a pair of rear support wheels 25A and 25B rotatingly mounted upon axle 26 affixed to frame 11 as illustrated. Pedestal 42 extends vertically and is affixed to base frame 11, as illustrated in FIGS. 1 and 2. mounted atop pedestal 42 is cable feeder head assembly 36. Cable 38 typically extends from drum 14 through cable guide tube assembly 39 and feeder head assembly 36. Attached to the end of cable 38 is a typical sewer cleaning claw 48.

Figure 3:
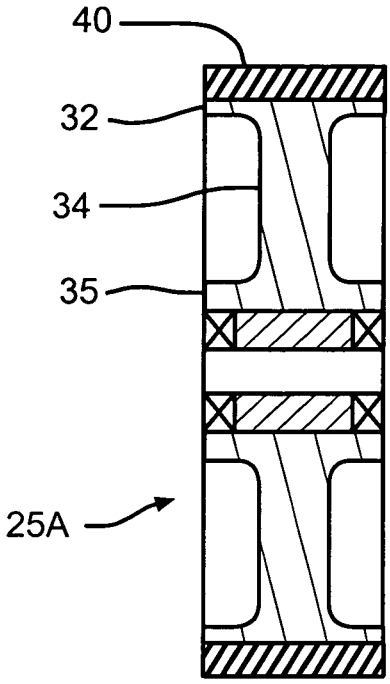
FIG. 3 presents a crossectional view taken along line 3-3 in FIG. 2.

As illustrated in FIG. 3, unitary wheel assembly 25 basically comprises a cast aluminum center disc 34, having an axially extending hub 35, an axially extending tire mounting rim 32 and a solid elastomeric tire 40. Solid tire 40 is preferably made of Styrene Butadiene Rubber (SBR) compound specifically having a Shore Durometer hardness of 75 and a thickness of one half of an inch adhesively affixed to wheel rim 32 or heat shrunk thereon.

Figure 6:
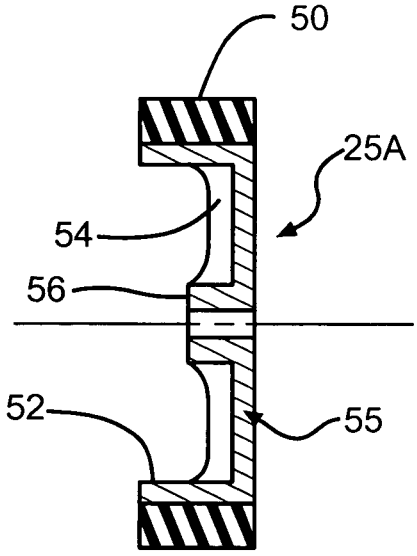
FIG. 6 present a crossectional view similar to that of FIG. 3 illustrating an alternate embodiment.

Alternatively, as illustrated in FIG. 6, wheel assembly 25 may comprises a cast aluminum center disc 55, having an axially extending hub 56 and an axially extending tire mounting rim 52 with a multiplicity of integral rim reinforcing spokes or webs 54, extending radially from hub 56 to rim 52, and a SBR tire 50 specifically having a Shore Durometer hardness of 75. Center disc 55, rim 52, hub 56 and webs 54 are preferably cast aluminum.

Figure 4:
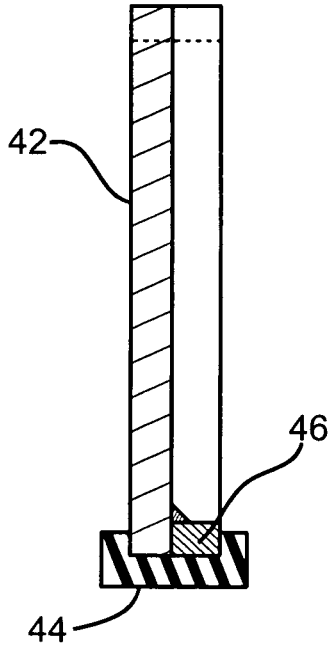
FIG. 4 presents a crossectional view taken along line 4-4 in FIG. 2.
Figure 5:
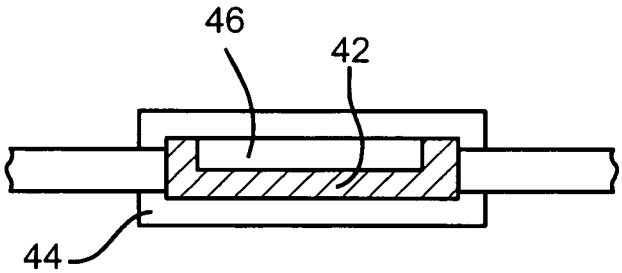
FIG. 5 presents a crossectional view taken along line 5-5 in FIG. 5.

Referring to FIGS. 4 and 5, pedestal 42 comprises a "U" shaped metal channel approximately eleven inches high, having an approximately five inch web and a two and one half inch flange. A metal plate 46 is welded across the bottom, of the channel, between the opposing flanges. A one inch thick, elastomeric shoe, preferably comprising a black Neoprene rubber composition having a Shore Durometer hardness of 75, shoe 44 is adhesively affixed to the bottom of pedestal 42 as illustrated in the figures.

Although the specific hardness of tires 40 and shoe 44 is a Shore Durometer of 75, it is believed that an acceptable hardness may lie between a Shore Durometer of 70 to 80.

A parking brake 50 is further provided, the operational mechanism of which is not shown as it comprises kinematic levers, well known within the industry, to forcibly engage tire 40 thereby preventing the drain cleaning machine from freely rolling on an uneven surface.

While I have described above the principles of my invention in connection with a specific preferred embodiment it is to be clearly understood that this description is made only by way of example and not as a limitation of the scope of my invention as set forth in the accompanying claims.

I claim:

1. In a drain cleaning machine having a supporting frame, a cable containing enclosure, supported upon said frame, for rotation about an axis of rotation, a drain cleaning cable coiled within said enclosure about said axis of rotation, the improvement comprising:

a) a pair of axially opposed support wheels rotatingly attached to the rear portion of said supporting frame, said wheels comprising:
   1) a wheel hub,
   2) a tire mounting rim circumscribing said wheel hub,
   3) a wheel disc extending radially from said wheel hub to the inside surface of said tire mounting rim, b) a solid elastomeric tire, having a thickness of one half inch, affixed to said tire mounting rim, said tire comprising a neoprene rubber compound having a Shore Durometer Hardness of between 70 and 80, c) a pedestal affixed to the forward portion of said support frame, and d) a solid elastomeric shoe, having a thickness of one inch, affixed to the bottom of said pedestal for contact with a supporting surface, wherein said shoe comprises a substantially flat, rectangular bottom surface sized and shaped to engage an underlying surface, said shoe comprising a neoprene rubber compound having a Shore Durometer Hardness of between 70 and 80.

2. The drain cleaning machine as claimed in claim 1 wherein said wheel disc, said tire mounting rim, and said wheel hub are one piece cast aluminum.

3. The drain cleaning machine as claimed in claim 1 wherein the Shore Durometer Hardness of said tire and shoe is 75.

* * * * *